US005996170A

United States Patent [19]

Gierer et al.

[11] Patent Number: 5,996,170

[45] Date of Patent: Dec. 7, 1999

[54] WET/DRY VACUUM WITH NON-CYLINDRICAL CANISTER

[75] Inventors: Joseph T. Gierer, Glen Carbon, Ill.; Stuart V. Holsten, O'Fallon, Mo.; Kiyoshi Hoshino, Chesterfield, Mo.; David R. Hult, St. Peters, Mo.

[73] Assignee: Emerson Electric Co., St. Louis, Mo.

[21] Appl. No.: 09/088,309

[22] Filed: Jun. 1, 1998

[51] Int. Cl.[6] ..... A47L 5/00

[52] U.S. Cl. ..... 15/323; 15/327.2; 15/327.6; 220/675; 220/782; 220/792

[58] Field of Search ..... 15/321, 323, 327.2, 15/327.6; 220/646, 651, 652, 653, 671, 675, 782, 792, 800, 802, DIG. 13

[56] References Cited

U.S. PATENT DOCUMENTS

| | | | |
|---|---|---|---|
| 2,947,463 | 8/1960 | Conklin | 220/782 |
| 3,165,774 | 1/1965 | Barba | 15/323 |
| 4,177,934 | 12/1979 | Hammes et al. | 220/675 |
| 4,349,119 | 9/1982 | Letica | 220/675 |
| 4,574,974 | 3/1986 | Von Holdt | 220/782 |
| 4,640,435 | 2/1987 | Dutt | 220/782 |
| 4,715,083 | 12/1987 | Harris et al. | 15/323 |
| 4,797,072 | 1/1989 | Berfield et al. | 417/423.2 |
| 4,881,658 | 11/1989 | VanCucha | 220/792 |
| 5,408,722 | 4/1995 | Berfield | 15/327.6 |
| 5,435,451 | 7/1995 | Dyer | 220/675 |
| 5,464,115 | 11/1995 | Tisbo et al. | 220/675 |
| 5,535,500 | 7/1996 | Stephens et al. | 29/453 |
| 5,548,868 | 8/1996 | Berfield et al. | 15/339 |
| 5,555,600 | 9/1996 | Corson | 15/327.2 |
| 5,560,075 | 10/1996 | Jankowski | 15/327.6 |
| 5,598,605 | 2/1997 | Tomasiak | 16/45 |
| 5,606,769 | 3/1997 | Tomasiak et al. | 15/327.6 |
| 5,608,945 | 3/1997 | Crouser et al. | 15/328 |
| 5,611,107 | 3/1997 | Tomasiak et al. | 15/327.2 |
| 5,784,753 | 7/1998 | Kaczmarz et al. | 15/321 |

*Primary Examiner*—Terrence R. Till
*Assistant Examiner*—Theresa T. Snider
*Attorney, Agent, or Firm*—Arnold, White & Durkee

[57] ABSTRACT

A wet/dry vacuum appliance having a non-cylindrical collection canister is disclosed. In one embodiment, the collection canister has substantially cylindrical ends and substantially flatter sides. A collection canister lid is adapted to engage the canister around a top perimeter thereof, supporting the canister such that the lid cooperates with the canister to resist the collapse of the canister when subjected to vacuum forces resulting from operation of the vacuum.

16 Claims, 9 Drawing Sheets

WET/DRY VACUUM WITH NON-CYLINDRICAL CANISTER

FIELD OF THE INVENTION

This invention relates generally to the field of vacuum cleaner appliances, and more particularly relates to a wet/dry type of vacuum cleaner.

BACKGROUND OF THE INVENTION

Vacuum cleaner appliances capable of picking up both wet and dry material, commonly referred to as wet/dry vacuums or wet/dry vacs, are well-known. Wet/dry vacs are often used in workshops and other environments where both wet and dry debris can accumulate.

Wet/dry vacs conventionally consist of a collection tank or canister, often mounted on wheels or casters, and a cover or lid upon which a motor and impeller assembly is mounted. The motor and impeller assembly creates a suction within the canister, such that debris and liquid are drawn in to the canister through an air inlet to which a flexible hose can be attached. A filter within the canister prevents incoming debris and liquid from escaping from the canister while allowing filtered air to escape. One example of a such a wet/dry vac is shown in U.S. Pat. No. 4,797,072.

A very substantial vacuum pressure can be created within the collection canister of a wet/dry vac. This is perhaps the primary reason why, in a majority of currently available wet/dry vacs, the collection canister is substantially cylindrical in its structural configuration. As is well known, such a cylindrical configuration is very capable of withstanding high vacuum pressure forces.

There are at least several reasons why cylindrically-configured collection canisters for wet/dry vacs may be less than ideal. From a functional standpoint, a cylindrical configuration is not conveniently scalable. That is, as the capacity or size of the collection canister is increased, the overall height of the appliance likewise must increase. This is undesirable for several reasons, including the fact that it makes the appliance inconvenient to store and to move around, and that it increases the height of the center of gravity and hence the instability of the appliance. (The problem of vertical instability of wet/dry vacs has been recognized in the prior art; see, e.g., U.S. Pat. No. 5,560,075 to Jankowski, entitled "Wet or Dry Vacuum With Low Center of Gravity".)

Other prior art examples of wet/dry vacuums include: U.S. Pat. No. 5,548,868 to Berfield et al., entitled "Pilot and Detent Apparatus for a Vacuum Device;" U.S. Pat. No. 5,535,500 to Stephens et al., entitled "Method for Manufacturing a Bucket for a Wet/Dry Vacuum;" U.S. Pat. No. 5,598,605 to Tomasiak, entitled "Wet/Dry Utility Vacuum with a Wheel Mount;" U.S. Pat. No. 5,555,600 to Corson, entitled "Non-Tipping Wet/Dry Vacuum;" U.S. Pat. No. 5,606,769 to Tomasiak, entitled "Wet/Dry Utility Vacuum Cleaner with Detachable Blower;" U.S. Pat. No. 5,608,945 to Crouser, et al., entitled "Wet/Dry Utility Vacuum Cleaner;" and U.S. Pat. No. 5,611,107 to Tomasiak et al., entitled "Latching Mechanism for Wet/Dry Utility Vacuum Cleaner with Detachable Blower." The above-noted Tomasiak '605, '769 and '107 patents are commonly assigned to the assignee of the present invention, and are hereby incorporated by reference herein in their respective entireties.

While cylindrical vacuum collection canisters have some perceived disadvantages, most presently commercially-available wet/dry vacs have cylindrical canisters. Perhaps the principal reason for this is that non-cylindrical vacuum canisters can require obtrusive or extraordinary means for preventing collapse under the very high vacuum pressures generated in wet/dry vac systems. Such means could include, for example, exceptionally wide canister rims, or structural ribs and stiffeners on the inside and/or outside of the canister, or very thick wall sections. Such features would be undesirable from the standpoints of manufacturability, aesthetics, and ergonomics. In addition, internal stiffening structures could adversely affect the pneumatic/hydraulic performance of the vacuum, and would make the canister more difficult to empty and clean.

Of course, a vacuum canister can be made sufficiently strong enough to withstand the vacuum forces to which it is to be subjected by using very strong materials. However, such materials, e.g., metal, can be expensive and heavy, and are less than ideal for this purpose. Instead, conventional wet/dry vac canisters are preferably made of injection-molded plastics or the like, which are reasonably strong at appropriate thicknesses, and advantageously inexpensive and light-weight. Again, while plastic canisters can be made sufficiently strong by increasing their thickness, it is desirable from the standpoint of manufacturing expense, weight, and so on, to make the canisters as thin-walled as possible.

For smaller capacity wet/dry vacs, e.g., 3-gallon vacs, for instance, the problem of potential canister collapse is not as great, making non-cylindrical canister configurations more feasible. One reason for this is that smaller capacity vacs tend to have smaller motors which generate lower levels of vacuum pressure. Also, smaller canisters can readily be made sturdy and resistant to collapse without undue increases in weight, size, manufacturing cost, and so on. For larger capacity vacs, e.g., 12- or 16-gallon canisters, however, the potential for non-cylindrical canister collapse is considerably greater, and the approaches to making the canisters resistant to collapse that can be taken for smaller vacs are not as feasible or effective in terms of size, weight, manufacturing cost, etc . . . .

SUMMARY OF THE INVENTION

In view of the foregoing, the present invention is directed to a wet/dry vacuum appliance in which the collection canister has a non-cylindrical configuration.

BRIEF DESCRIPTION OF THE DRAWINGS

Various features and aspects of the present invention will perhaps be best appreciated with reference to detailed descriptions of specific embodiments of the invention, when read in conjunction with the accompanying drawings, wherein.

DETAILED DESCRIPTION OF SPECIFIC EMBODIMENTS OF THE INVENTION

Figure 1:
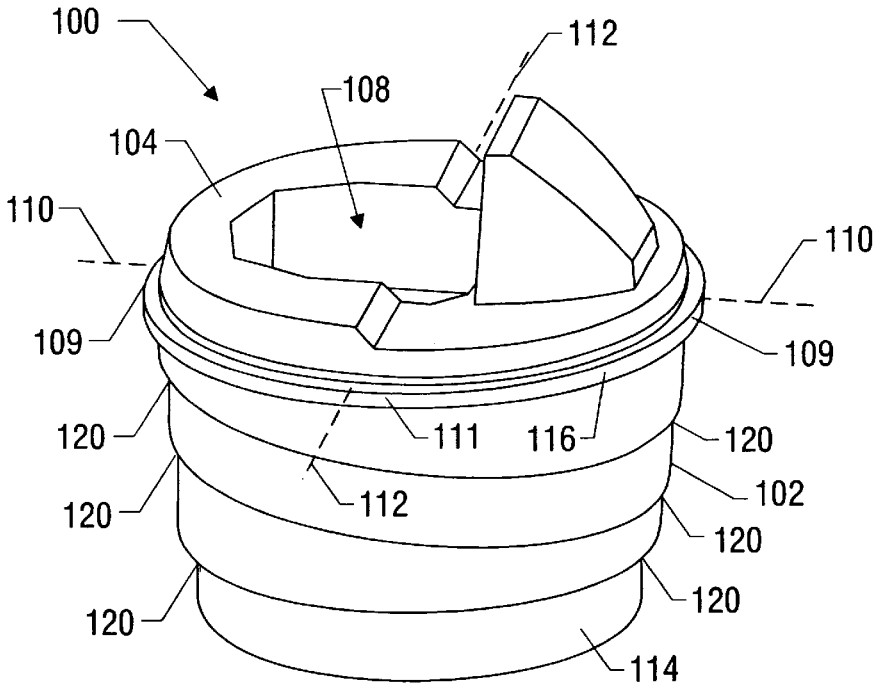
FIG. 1 is a perspective view of a wet/dry vacuum canister and lid assembly in accordance with one embodiment of the invention.
Figure 2:
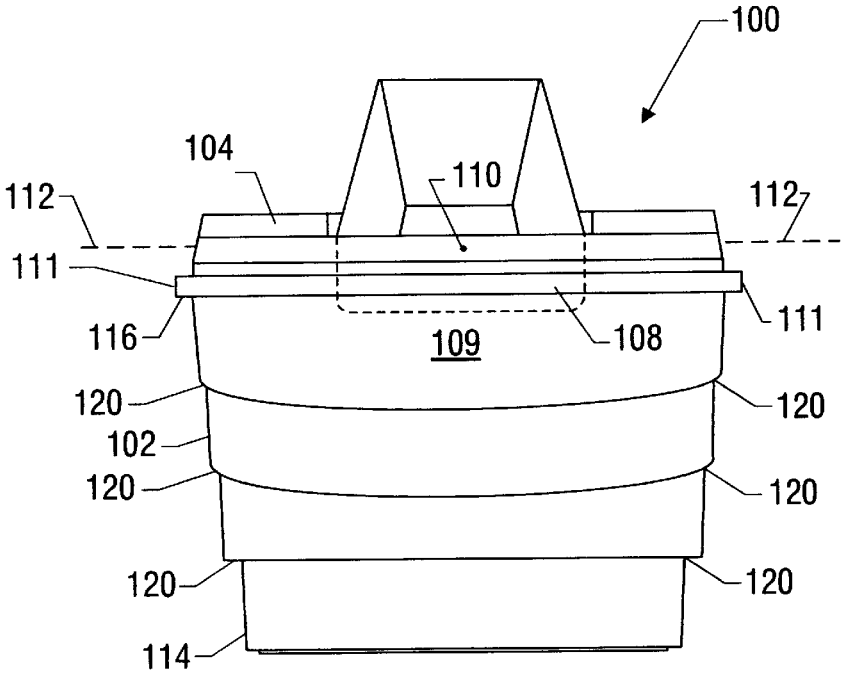
FIG. 2 is an end view of the canister and lid assembly from FIG. 1.
Figure 3:
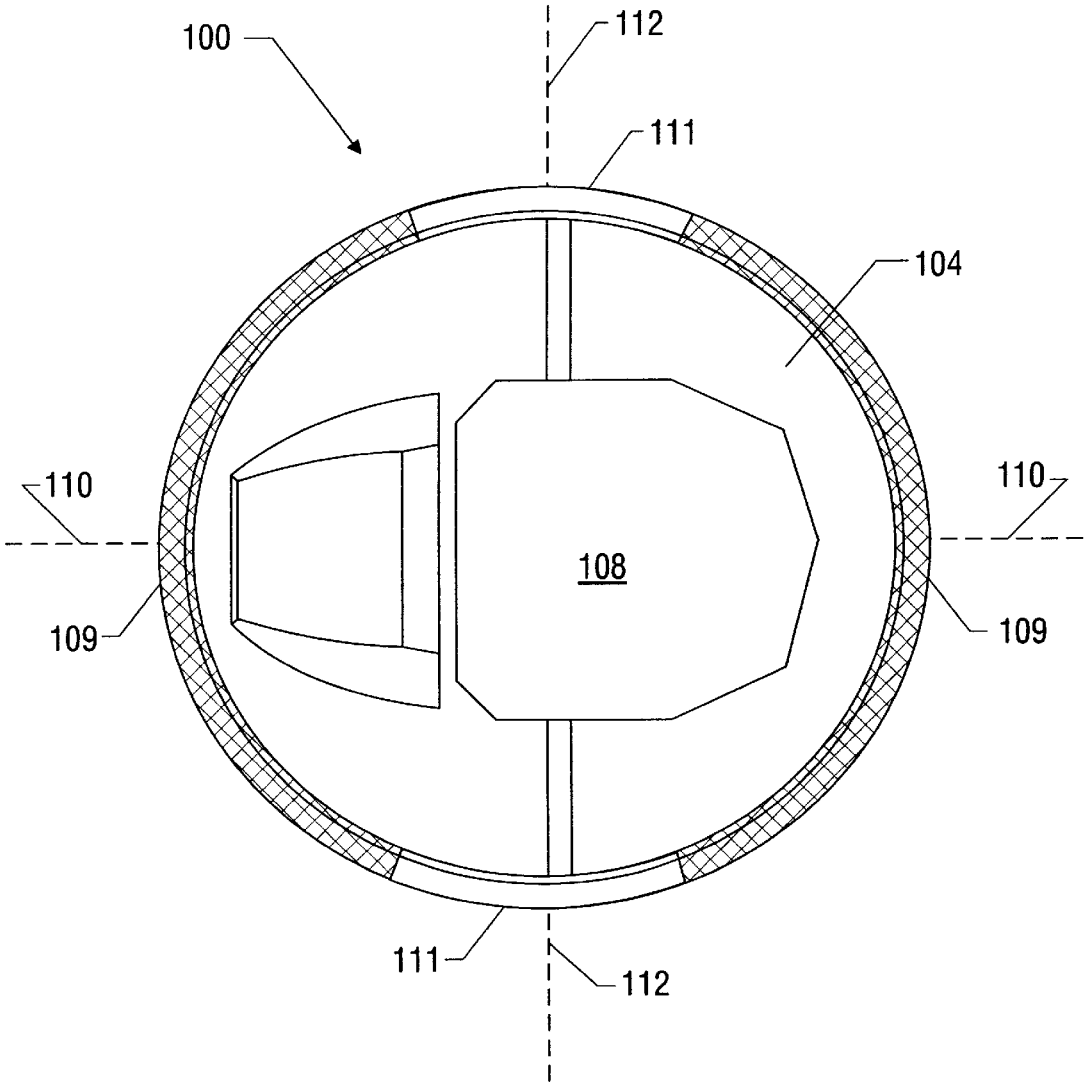
FIG. 3 is a top view or the canister and lid assembly from FIG. 1.
Figure 4:
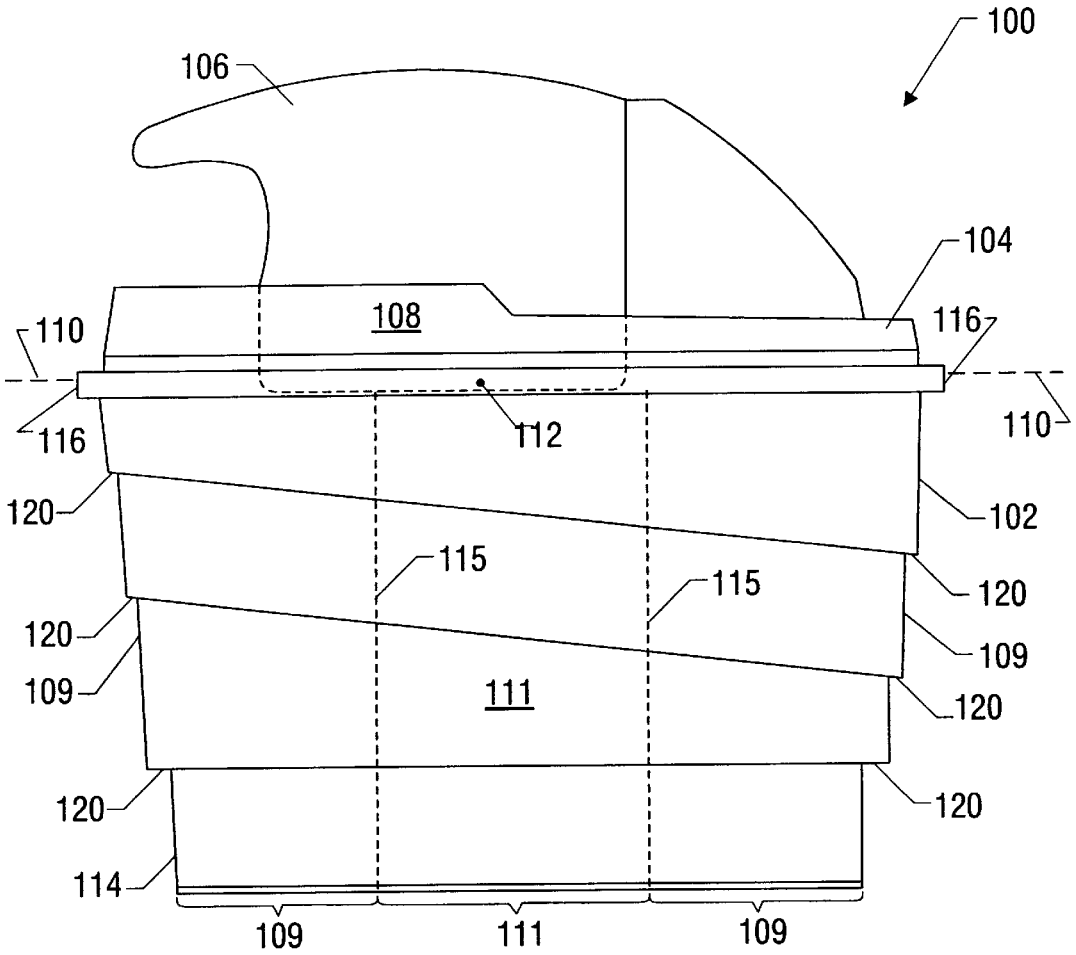
FIG. 4 is a side view of the canister and lid assembly from FIG. 1.
Figure 5:
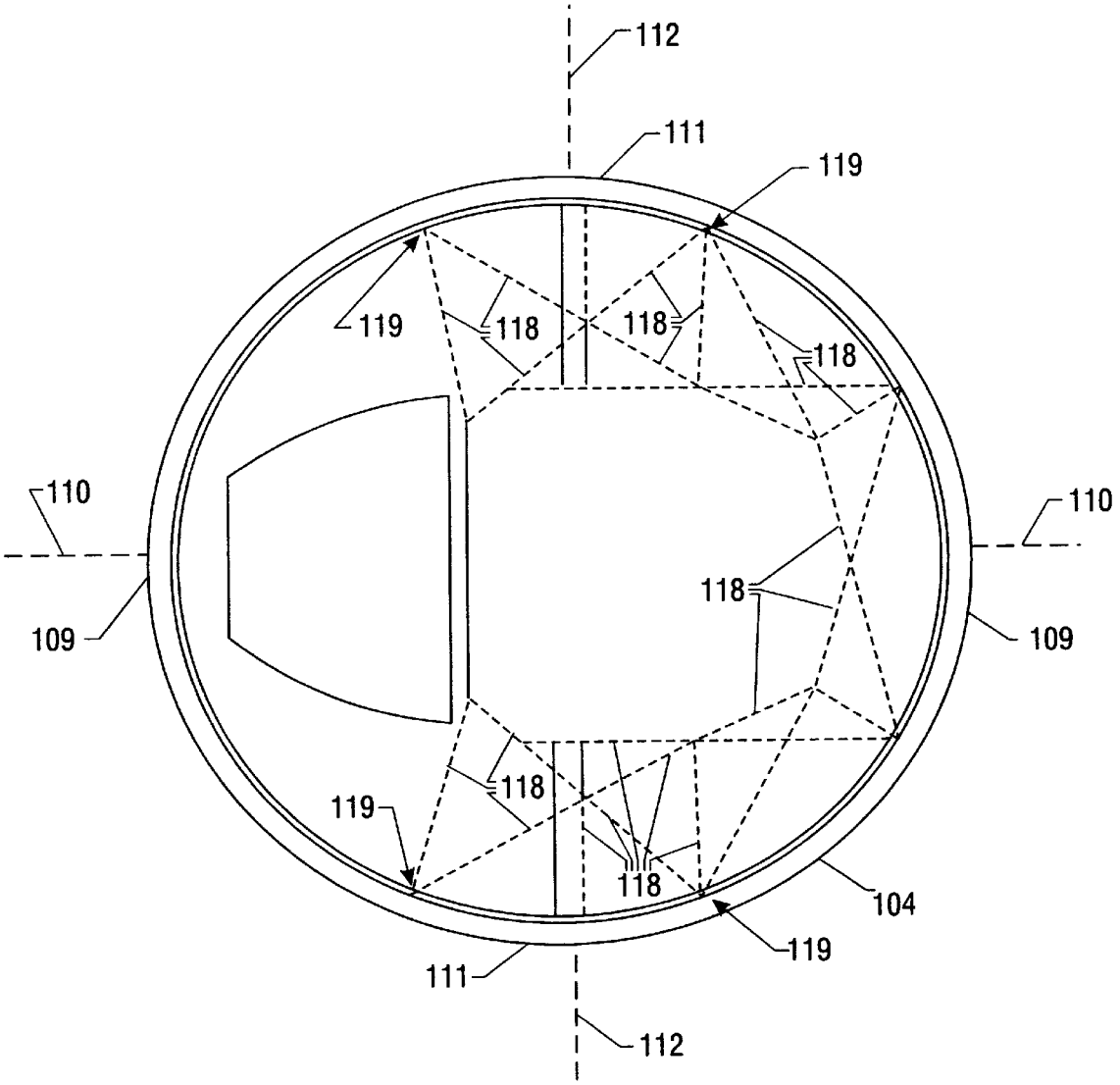
FIG. 5 is a bottom view of the lid in the canister and lid assembly from FIG. 1 showing a pattern of reinforcing ribs formed thereon.

Referring first to FIGS. 1–6, there are shown various views of a non-cylindrical wet/dry vacuum canister and lid assembly 100 in accordance with one embodiment of the present invention. Specifically, FIG. 1 is a perspective view, FIG. 2 is a front (end) view, FIG. 3 is a top view, FIG. 4 is a side view of canister and lid assembly 100, and FIG. 5 is a bottom view of the lid 104 in lid assembly 100.

As shown in FIGS. 1–6, canister and lid assembly 100 comprises two main components: a canister, designated with reference numeral 102, and a lid designated with reference numeral 104. In accordance with one aspect of the presently disclosed embodiment of the invention, wet/dry vacuum system of which assembly 100 is a part is preferably of the type having a removable power head, which is shown only in FIG. 4 and which is designated therein with reference numeral 106.

Wet/dry vacs with removable power heads are well-known, and at least several varieties of such vacs are commercially available. The power head, like power head 106 shown in FIG. 4, is mountable in a sealed relationship with the vacuum lid (e.g., lid 104 in FIGS. 1–6) positioned above the canister. When the power head of such a vac is separated from the lid, it is adapted to receive a hose, wand, or the like, so as to be useful as a blower. The above-referenced Tomasiak '769 patent discloses one example of a wet/dry vac having a detachable power head.

Although the presently disclosed embodiment of the invention is adapted for incorporation into a wet/dry vac having a detachable power head, it is to be understood that the present invention may be just as advantageously practiced in conjunction with other types of wet/dry vacs, including those having a non-detachable power head.

With continued reference to FIGS. 1–6, lid 104 is configured so as to define a recess or pocket 108, so as to be capable of receiving detachable power head 106 therein. Latches, not shown, may be provided for securing power head 106 within recess 108.

Canister 102 and lid 104 function together to provide the necessary structural framework for resisting the high negative (vacuum) pressure loads that can tend to buckle and collapse the side of vac canisters, as will be hereinafter described in further detail.

In the presently disclosed embodiment, canister 102 is characterized by having two ends designated with reference numeral 109 in the Figures, and two sidewalls designated with reference numeral 111. In particular, canister 102 is configured such that true cylindrical pressure vessel shapes, i.e., partial cylinders, are used to define the ends 109 of canister 102, through which the "long" axis designated with dashed line 110 in the Figures passes. In one embodiment, canister ends 109 are substantially round or cylindrical and each has a radius of curvature of approximately 7.5 inches at the base 114 of canister 102. The extent of ends 109 in the presently disclosed embodiment is 150°, as indicated by the cross-hatching in FIG. 3. Also, dashed lines 115 in FIG. 4 indicate the division between ends 109 and sidewalls 111 of canister 102.

Canister 102 is further configured to have substantially flatter sidewalls 111 disposed between and tangent to ends 109, through which the "short" axis designated with dashed line 112 in the Figures passes. In one embodiment, sidewalls 111 have a radius of curvature of 11.5 inches at base 114.

Advantageously, the lengthening of one dimension of canister 102, i.e., along the "long" axis 110 due to the substantially larger radius sidewalls 111, allows for a reduced height without reducing capacity. This tends to enhance the overall vacuum system's stability, by lowering its center of gravity.

Because of the larger radius of sidewalls 111 as compared with ends 109, however, canister 102 is more vulnerable to collapsing at sidewalls 111 under negative pressure. However, in accordance with one aspect of the invention, canister 102 and lid 104 are configured to interactively resist collapse. In particular, canister 102 and lid 104 engage each other at their interface 116 such that lid 104 provides support for the upper rim of canister 102 against forces acting on sidewalls 111.

In one embodiment of the invention, lid 104 is provided with a truss-like system of ribs 118 on its underside, as represented by dashed lines 118 in FIG. 5, which give lid 104 added strength to perform its function of supporting canister 102 against vacuum forces which may tend to collapse the sidewalls 111. It is contemplated that portions of ribs 118 may extend downward from the underside of lid 104 sufficiently far so as to be capable of engaging the inner wall of canister 102 at the rim thereof, thereby further supporting the rim of canister 102 from collapsing.

Figure 6:
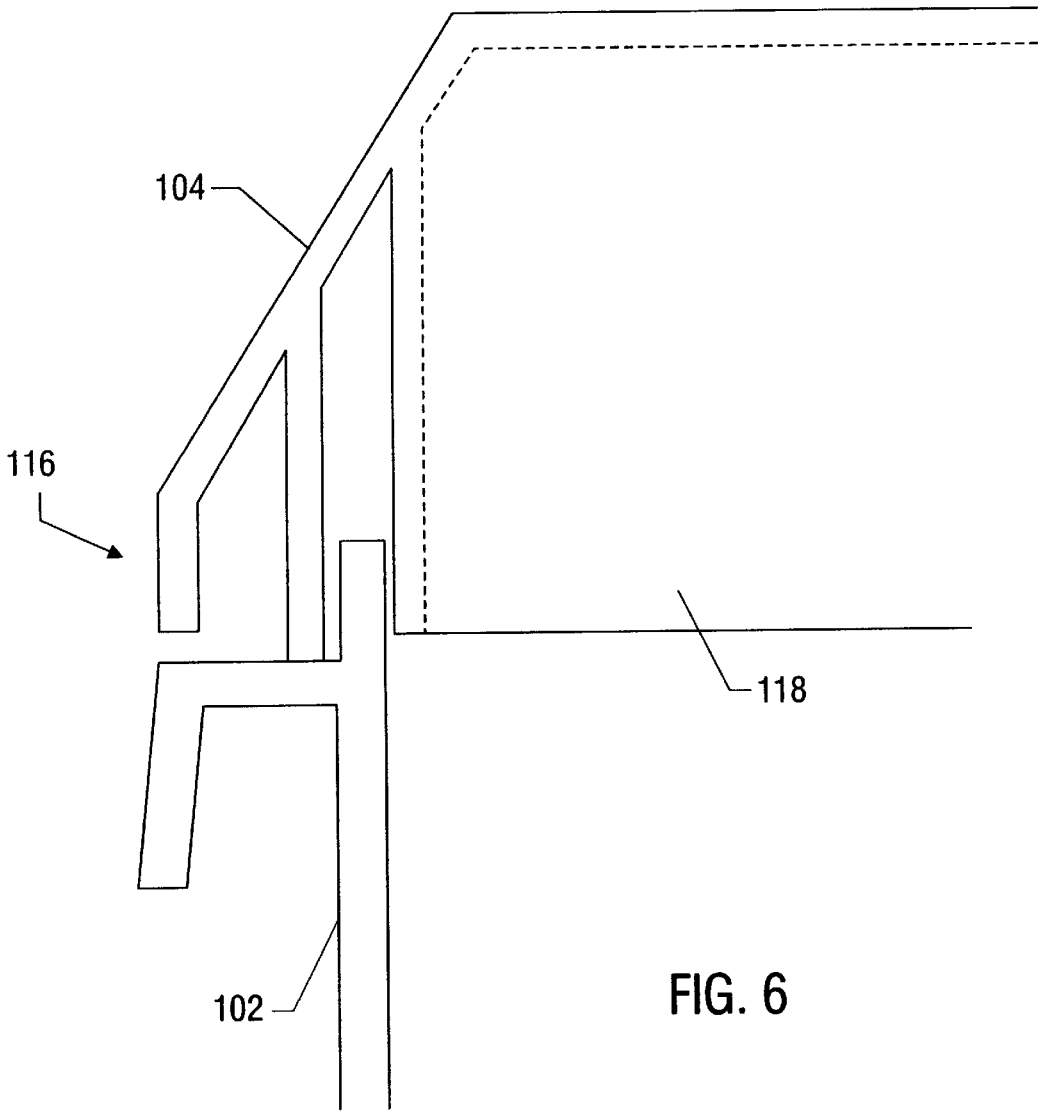
FIG. 6 is a partial cross-sectional view of the canister and lid assembly from FIG. 1.

For example, in FIG. 5, ribs 118 in the regions designated generally with reference numerals 119 may extend downward below the bottom edge of lid 104, such that when lid 104 was secured on top of canister 102, ribs 118 in regions 119 engage the sidewalls 111 of canister 102, thereby interactively contributing to the strength of canister and lid assembly to vacuum forces. That is, ribs 118, by engagement with the sidewalls 111 of canister 102, can support the side walls of canister 102. This is shown in more detail in FIG. 6, which shows in cross section portions of canister 102 and lid 104 in the region of interface 116 therebetween. As shown in FIG. 6, canister 102 and lid 104 are configured to interlock with one another such that an extending portion of rib 118 is disposed generally against or at least in close proximity to the inner side wall of canister 102, preferably on a side 111 thereof. In this way, forces on canister 102 arising from vacuum pressure developed therein, which may tend to compress sides 111 inward, are borne at least in part by rib 118. The truss-like structure of ribs 118 on lid 104 therefore act as stiffeners across the top of the non-cylindrical canister 102, supporting the canister in its weak direction when vacuum loads are applied.

In accordance with another aspect of the presently disclosed embodiment of the invention, canister 102 is configured to have a plurality of circumferential step-like increases in radius 120 in its side walls. These circumferential steps 120 in the radius of canister 102 perform at least two functions. First, as will be appreciated by those of ordinary skill in the art, each step 120 tends to increase the rigidity of the side walls of canister 102, in the same way that similar bends, folds or corrugations in sheet metal products (e.g., automobile body parts) tend to increase those products' rigidity. This enhances the structural integrity of canister 102.

In addition, steps 120 in canister 102 facilitate the widening of the radius of canister 102 from bottom to top, thereby increasing its capacity without increasing its "footprint." (While steps 120 are shown in the Figures as being angled (i.e., not parallel to the ground) from side 109 to side 109, this is not believed to be critical to the invention, and it is contemplated that steps 120 could with equal advantage be non-angled (i.e., parallel to the ground).)

In the presently disclosed embodiment of the invention, canister 102 and lid 104 are preferably made of moldable plastic, such as polypropylene, polyethylene, or the like. Because of the configuration of canister 102 and lid 104 and their ability to cooperatively resist negative pressure forces, the walls of canister 102 are able to be reasonably thin (on the order of 0.150 inches or so). This advantageously allows for efficient and reproducible molding and short molding cycle times.

Canister 102 in FIGS. 1–6 preferably has a capacity of 12 to 16 gallons or so, although it is to be understood that the principles of the present invention can be advantageously applied to vacuum canisters of any size.

Although not shown in the Figures, it is contemplated that canister 102 can be adapted to accept caster assemblies around the base 114 thereof, in a more or less conventional manner, to allow for convenient mobility of the wet/vac system. A suitable caster assembly, which additionally provides for convenient accessory storage, is disclosed in U.S. Pat. No. 5,924,165 entitled "Improved Caster Foot with Accessory Storage" which patent is hereby incorporated by reference in its entirety.

Turning now to FIGS. 7–11, there is shown a non-cylindrical wet/dry vacuum canister 202 in accordance with an alternative embodiment of the present invention. Like canister 102 in the embodiment of FIGS. 1–6, canister 202 has a "long" axis 210 and a "short" axis 212, and is comprised of two substantially half-cylindrical ends with two "side" elements 211 disposed therebetween. It is to be understood that canister 202 is adapted to be coupled with a lid, not shown in the figures, which may be, for example, substantially similar to lid 104 in the embodiment of FIGS. 1–6.

Figure 8:
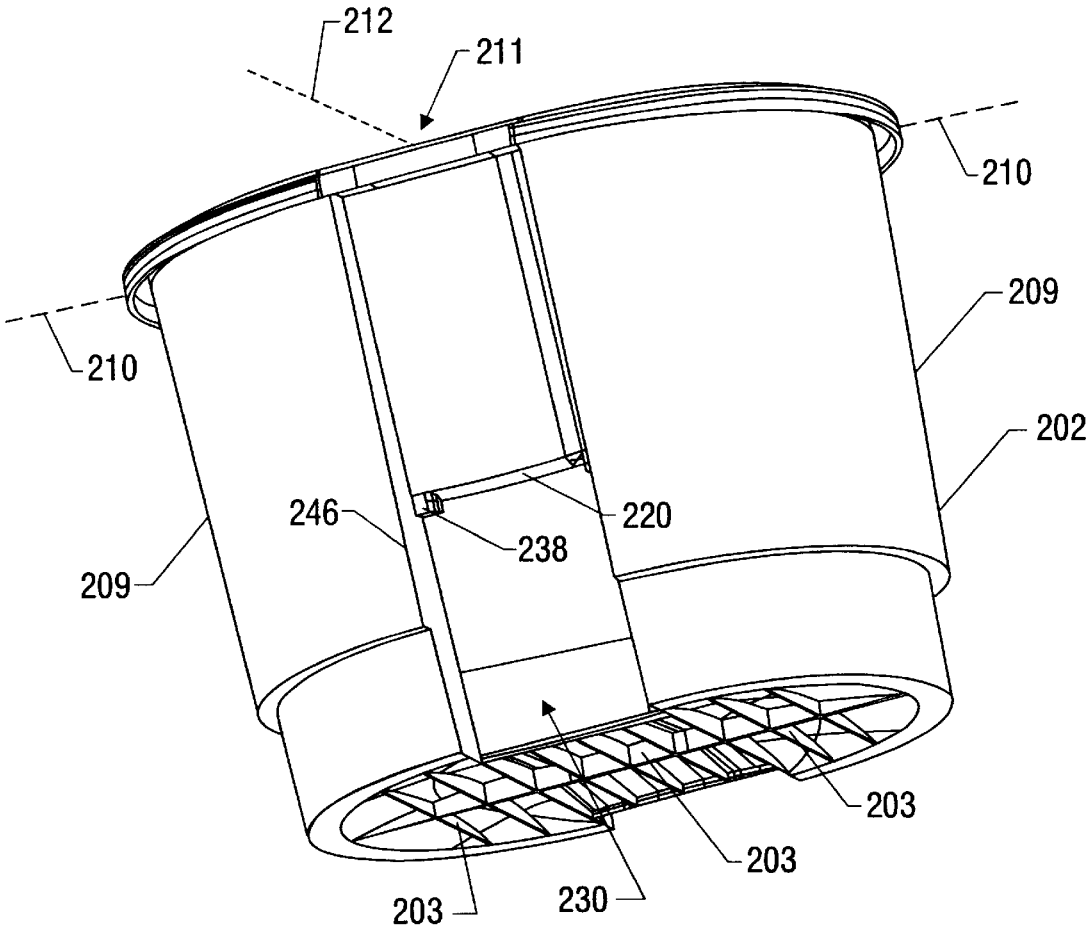
FIG. 8 is another perspective view of the canister from FIG. 7.

Canister 202 may be provided with a plurality of ribs 203 on the bottom thereof, as shown in FIG. 8.

Figure 7:
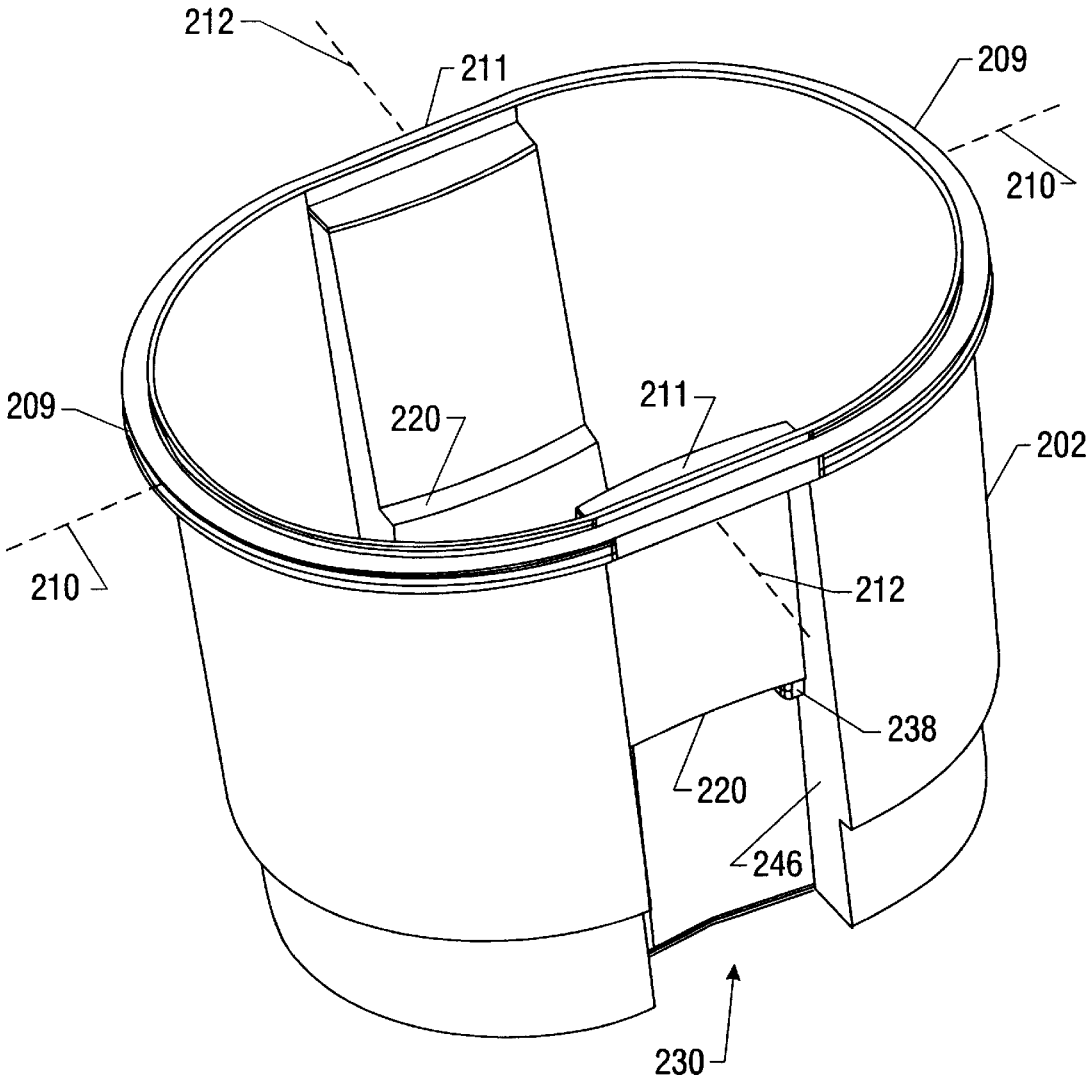
FIG. 7 is a perspective view of a non-cylindrical wet/dry vacuum canister in accordance with an alternative embodiment of the invention.

As shown in the Figures, sides 211 of canister 202 essentially define recesses 230 in the walls of canister 202. In one embodiment, recesses 230 formed by sides 211 have a slight concave radius of curvature, i.e., a curvature opposite to the radii of curvature of ends 209, as can be seen in FIG. 7, for example. Also, in one embodiment, one or more steps or transitions 220 are defined in sides 211, one such transition 220 being shown or each side 211 in FIGS. 7–11.

Like steps 120 in the embodiment of FIGS. 1–6, step 220 in the embodiment of FIGS. 7–11 tends to enhance the rigidity of sides 211, and hence of canister 202 overall. Nonetheless, the non-cylindrical configuration of canister 202 makes it a less-than-ideal pressure vessel, and hence vulnerable to collapsing under the high negative pressures that may be generated therein.

Figure 9:
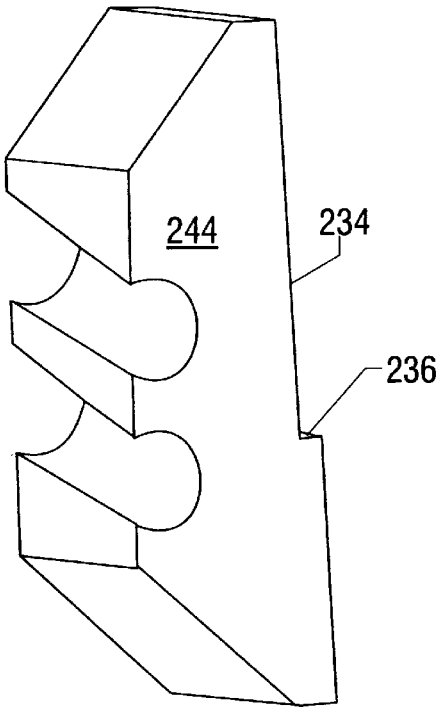
FIG. 9 is a perspective view of a stiffening member associated with the canister from FIG. 7.
Figure 10:
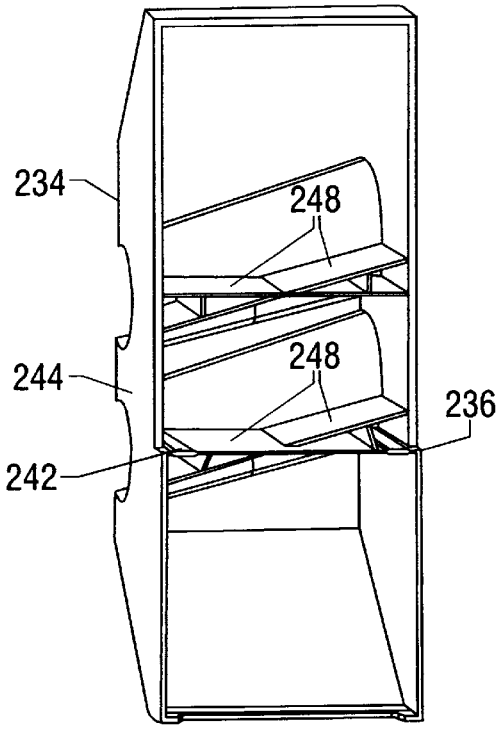
FIG. 10 is another perspective view of the stiffening member from FIG. 9.

Accordingly, in the embodiment of FIGS. 7–11, stiffening members 234, shown in FIGS. 9 and 10 are provided. Stiffening members 234 are configured to be received within recesses 230 defined by sides 211 of canister 202. Accordingly, members 234 have a "step" or transition 236 defined in a back side thereof corresponding to transitions 220 in sides 211 of canister 202.

Figure 11:
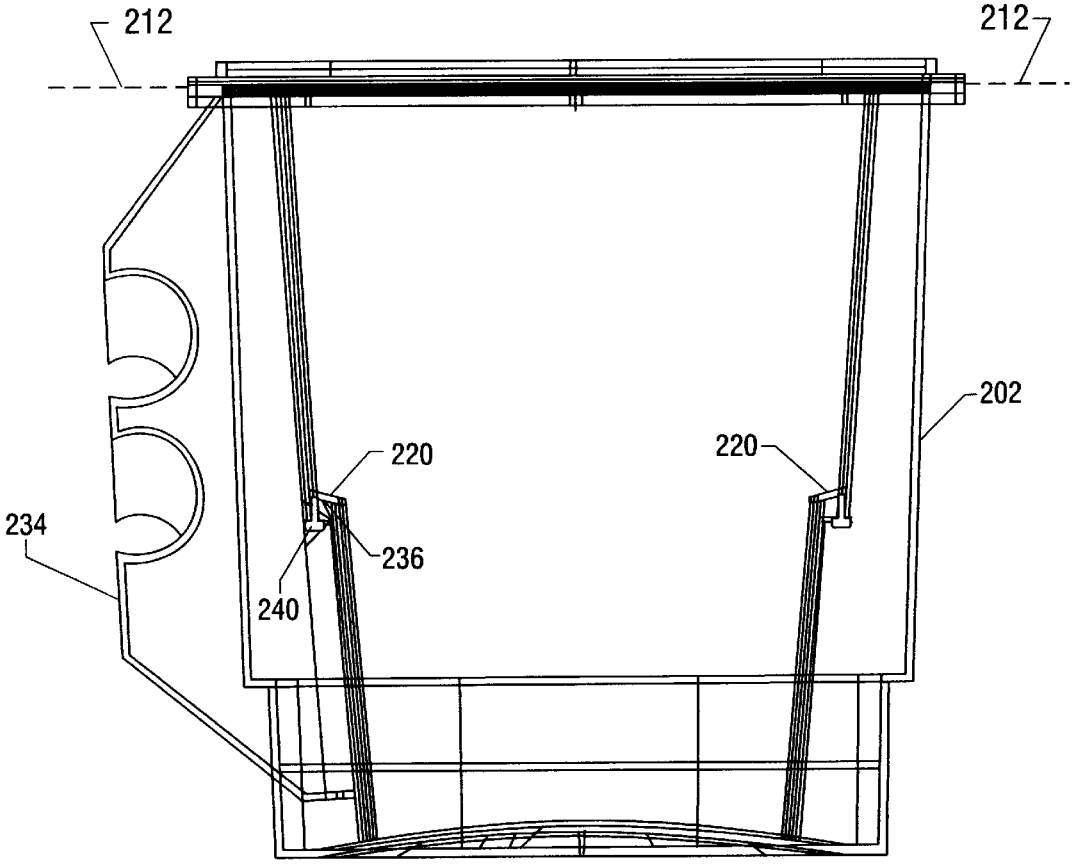
FIG. 11 is a cross-sectional view of the canister and stiffening member from FIGS. 7–10.

FIG. 11 is a cross-sectional side view showing one stiffening member 234 disposed within a recess 230 defined by side 211 of canister 202. A screw boss 238 is formed within recess, integrally with side 211, generally in the region of transition 220, such that a screw 240 can be inserted through screw hole 242 to secure stiffening member 234 to canister 202.

When sufficient negative pressure is established within canister 202 may tend to deform (collapse), especially at sides 211 which are not cylindrical pressure vessels like sides 209. When this deformation or collapsing occurs, the sides 244 of stiffening members 234 will be compressed against the sides 246 of recesses 230. Stiffening members 234 preferably have one or more ribs or trusses 248 therein, as shown in FIG. 10, such that stiffening members can resist the force against sides 244 exerted by sides 246 of recesses 230, thereby preventing canister 202 from collapsing.

In one embodiment of the invention, stiffening members 234 are configured to serve as accessory holders. For example, stiffening members may have sockets formed therein such that one or more detachable vacuum nozzles may be secured thereto.

From the foregoing detailed description of specific embodiments of the invention, it should be apparent that a non-cylindrical vacuum canister has been disclosed. Although specific embodiments of the invention have been described herein in detail, this has been done solely for the purposes of illustrating various aspects of the invention, and is not intended to be limiting with respect to the scope of the invention. It is contemplated that various substitutions, alternations, and/or modifications, including but not limited to those design variations which may have been specifically mentioned herein, may be made to the disclosed embodiments without departing from the spirit and scope of the invention, as defined in the following claims.

What is claimed is:

1. A canister and lid assembly for a wet/dry vacuum cleaning appliance, comprising:

a non-cylindrical collection canister comprising substantially curved ends and sides substantially flatter than said curved ends, said canister being constructed of a material capable of being collapsed under vacuum loads;

a lid, adapted to engage said canister around a top perimeter thereof, supporting said canister such that said lid cooperates with said canister to resist collapse of said assembly.

2. An assembly in accordance with claim 1, wherein said lid includes structural support ribs on an underside thereof for cooperating with said canister to resist vacuum loads on said sides of said canister.

3. An assembly in accordance with claim 2, wherein at least one of said ribs extends down from said underside of said lid so as to be disposed against one of said sides of said canister.

4. An assembly in accordance with claim 1, wherein said canister has at least one circumferential step in radius defined in said sides and ends.

5. An assembly in accordance with claim 4, wherein said canister and lid are made of molded plastic.

6. An assembly in accordance with claim 1, wherein said canister has a capacity of at least 10 gallons.

7. A wet/dry vacuum, comprising:

a non-cylindrical vacuum canister comprising substantially curved ends and sides substantially flatter than said curved ends, said canister being constructed of a material capable of being collapsed under vacuum loads;

a lid, adapted to engage said canister around a top perimeter thereof, supporting said canister such that said lid cooperates with said canister to resist collapse of said canister;

a power head, mounted on said lid, for generating vacuum pressure within said canister.

8. A wet/dry vacuum in accordance with claim 7, wherein said power head is detachable from said lid.

9. A wet/dry vacuum in accordance with claim 7, wherein said lid includes structural support ribs on an underside thereof for cooperating with said canister to resist vacuum loads on said sides of said canister.

10. A wet/dry vacuum in accordance with claim 9, wherein at least one of said ribs extends down from said underside of said lid so as to be disposed against one of said sides of said canister.

11. A wet/dry vacuum in accordance with claim 7, wherein said canister has at least one circumferential step in radius defined in said sides and ends.

12. A wet/dry vacuum in accordance with claim 11, wherein said canister and lid are made of molded plastic.

13. A wet/dry vacuum in accordance with claim 7, wherein said canister has a capacity of at least 10 gallons.

14. A canister assembly for a wet/dry vacuum appliance, comprising:

a non-cylindrical collection canister comprising substantially curved ends and sides substantially flatter than said curved ends, at least one of said sides having a recess formed therein configured to receive a stiffening member therein for resisting vacuum forces tending to cause collapsing deformation of said canister.

15. A canister assembly in accordance with claim 14, wherein said stiffening member is configured to serve as a vacuum accessory holder.

16. A canister assembly in accordance with claim 14, wherein said stiffening member is secured within said recess by means of at least one screw.

* * * * *